US008083817B2

(12) United States Patent
Kirchhübel et al.

(10) Patent No.: US 8,083,817 B2
(45) Date of Patent: Dec. 27, 2011

(54) ENTRAINED BED GASIFIER WITH A COLD SCREEN AND INTERNAL WATER JACKET

(75) Inventors: Volker Kirchhübel, Freiberg (DE); Friedemann Mehlhose, Freiberg (DE); Manfred Schingnitz, Freiberg (DE); Heidrun Toth, Freiberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/739,267

(22) PCT Filed: Sep. 24, 2008

(86) PCT No.: PCT/EP2008/062795

§ 371 (c)(1),
(2), (4) Date: Oct. 14, 2010

(87) PCT Pub. No.: WO2009/053204

PCT Pub. Date: Apr. 30, 2009

(65) Prior Publication Data

US 2011/0023362 A1 Feb. 3, 2011

(30) Foreign Application Priority Data

Oct. 25, 2007 (DE) ..... 10 2007 051 077

(51) Int. Cl.
*C10J 3/76* (2006.01)

(52) U.S. Cl. ..... 48/67; 48/72; 48/73; 48/76; 48/201; 48/200; 48/202; 48/61; 48/117; 48/203; 48/204; 48/71

(58) Field of Classification Search ..... 48/71, 76, 48/62 R, 63, 64, 77, 69, 127.9, 61; 122/5; 422/198, 203–205, 242
See application file for complete search history.

(56) References Cited

U.S. PATENT DOCUMENTS

| | | | | |
|---|---|---|---|---|
| 2,961,310 | A * | 11/1960 | Steever | 48/206 |
| 7,037,473 | B1 * | 5/2006 | Donner et al. | 422/242 |
| 2008/0222955 | A1 * | 9/2008 | Jancker et al. | 48/67 |

FOREIGN PATENT DOCUMENTS

| | | | |
|---|---|---|---|
| DE | 3623604 | A1 | 1/1988 |
| DE | 19718131 | A1 | 11/1998 |
| DE | 19817298 | C1 | 9/1999 |
| EP | 0254830 | A2 | 2/1988 |

OTHER PUBLICATIONS

Noell-Konversionsverfahren zur Verwertung und Entsorgung von Abfällen; EF-Verlag für Energie- und Umwelttechnik GmbH 1996, Berlin; pp. 32-33; J. Carl u. a.; ISBN: 3-924511-82-9; 1996; DE.

* cited by examiner

*Primary Examiner* — Kaity V. Handal

(57) ABSTRACT

An entrained bed gasifier for operation with particulate or liquid fuels is provided. A reaction chamber defined by a cold screen and a quenching chamber connected to the reaction chamber using a crude gas and slag outlet, wherein at least the cold screen is enclosed by a pressure-resistant pressure mantle. The annular gap between the cold screen and pressure jacket may be filled with a fluid, for example, water or heat transfer oil. A rough pressure equalization between the gasification chamber and the annual gap may be guaranteed using a connection between the annular gap and the quenching chamber or the crude gas line, hence the pressure in the gasification chamber normally remains slightly higher than in the inner water jacket.

5 Claims, 1 Drawing Sheet

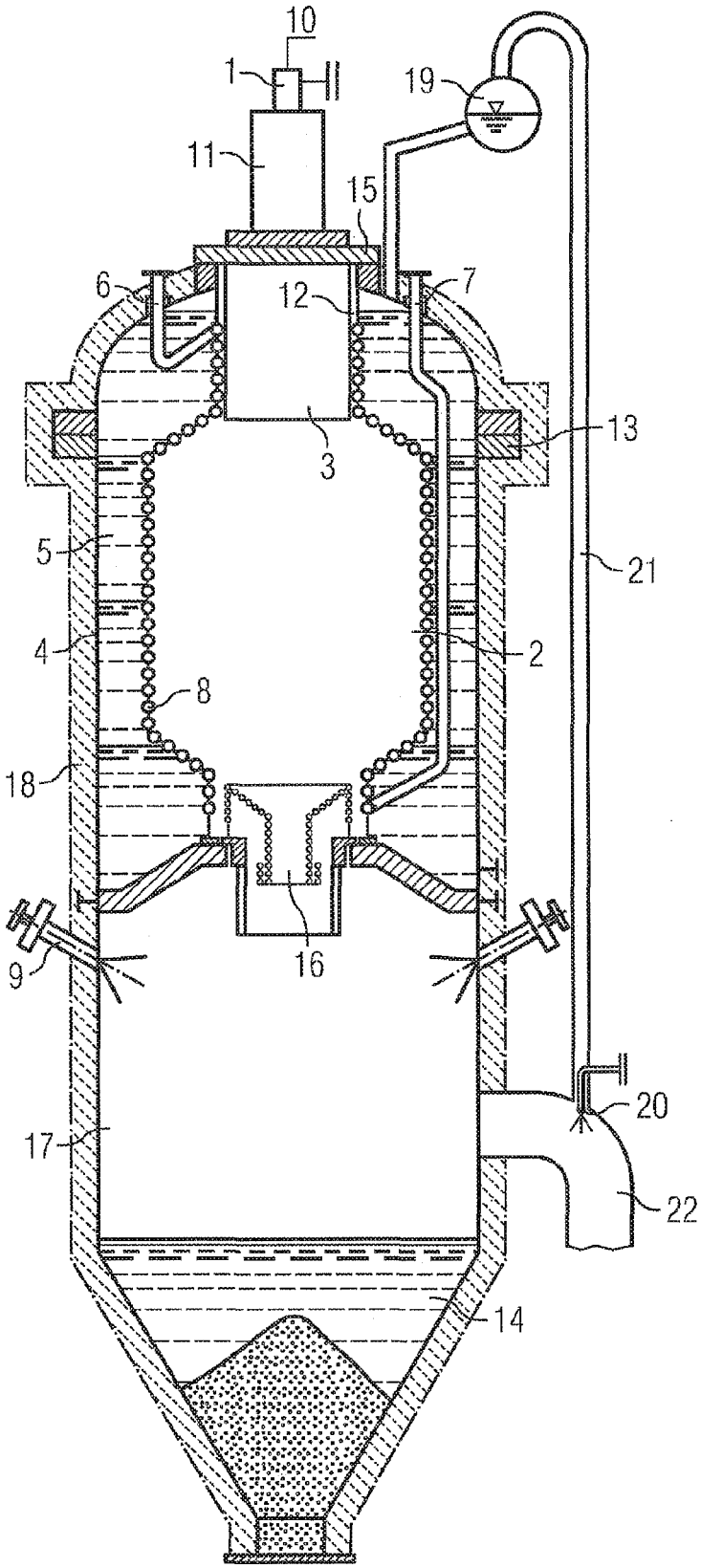
10
1
19
11
15
6
12
7
13
3
5
21
4
2
8
18
16
9
20
17
22
14

ENTRAINED BED GASIFIER WITH A COLD SCREEN AND INTERNAL WATER JACKET

CROSS REFERENCE TO RELATED APPLICATIONS

This application is the US National Stage of International Application No. PCT/EP2008/062795, filed Sep. 24, 2008 and claims the benefit thereof. The International Application claims the benefits of German application No. 10 2007 051 077.4 DE filed Oct. 25, 2007. All of the applications are incorporated by reference herein in their entirety.

FIELD OF INVENTION

The invention relates to a reactor for the gasification of solid and liquid fuels in the entrained bed having the features of the claims.

BACKGROUND OF INVENTION

The invention relates to a reactor for the entrained bed gasification of different solid and liquid fuels, comprising an oxidation means containing a free oxygen at normal or increased pressure up to 8 MPa. Solid fuels comprise in this case coal with different coalification degrees which are crushed to form dust, petrol coke and other crushable solids with a heating value of greater than 7 MJ/Nm$^3$. Liquid fuels are understood to mean oils or oil solid or water solid suspensions, such as for instance coal-water slurries. Autothermic entrained bed gasification has been known for many years within the field of gas generation from solid fuels. The ratio of fuel to oxygen-containing gasification means is selected here such that temperatures are reached which are above the melting point of the ash. The ash is then melted down to liquid slag, which leaves the gasification chamber together with the gasification gas or separately, and is then directly or indirectly cooled. Such an apparatus can be found in DE 197 181 31 A1.

A detailed description of such a gasification reactor equipped with a cold screen is found in J. Carl u.a., NOELL-KONVERSIONSVERFAHREN [Noell conversion process], EF-Verlag far Energie and Umwelttechnik GmbH 1996 [EF publishing company for energy and environmental engineering GmbH 1996], pages 32-33. In the conception described therein, a cold screen consisting of gas-tight welded cooling tubes is located inside a pressurized vessel. This cold screen is supported on an intermediate base and can extend freely upward. This ensures that no mechanical stresses can develop with the occurrence of different temperatures as a result of start up and shut down processes and length changes determined therefrom, which could if necessary result in a breakdown. To achieve this, there is no solid connection at the upper end of the cold screen but instead a gap between the cold screen collar and the burner flange, which ensures free moveability. To prevent a back flow of the cold screen gap in the case of pressure fluctuations in the system of gasification gas, the cold screen gap is flushed with a dry gas which is free of condensate and oxygen. As practice shows and despite the flushing, the gasification gas flows back, which leads to corrosion on the rear of the cold screen or on the pressure mantle. This may result in operating failures or even in the cold screen or the pressure jacket being destroyed.

SUMMARY OF INVENTION

The object of the present invention is to avoid the disadvantages mentioned above.

In accordance with the invention, these disadvantages are overcome by the solution given in the claims.

In accordance with the invention, the annular gap 5, as an internal water jacket, is filled with a liquid, in particular water or heat transfer oil, which offers the following further advantages:

The temperature of the cooling screen 8 with values between 20 and 300° C. corresponds to the temperature of the annular gap 5 as an internal water jacket and thus also the temperature of the pressure mantle.

The same temperature between the pressure jacket and the cooling screen means that differing extensions do not occur in the event of temperature changes, so that it is possible to dispense with a length compensation, using a corrugated pipe compensator for instance.

A connection between the annular gap 5 and the quenching chamber 17 or a point in the raw gas line 22 discharges the steam forming during the decompression processes or during normal operation, with at the same time an approximate pressure compensation being ensured between the gasification chamber 2 and the annular gap 5. In this way the pressure in the annualar gap 5 generally remains marginally higher than that in the gasification chamber 2.

In a further embodiment, technical features relating to the pressure regime between the gasification chamber and the annular gap are shown.

BRIEF DESCRIPTION OF THE DRAWINGS

The invention is described below as an exemplary embodiment on the basis of a FIGURE to the degree required for understanding, in which;

FIG. 1 shows a gasification reactor with an internal water jacket

DETAILED DESCRIPTION OF INVENTION

A gasification reactor according to FIG. 1 is fed 50 t mineral coal dust and 35.000 Nm$^3$ steam per hour by way of a gasification burner 1, which at the same time contains a pilot burner, this is converted in the gasification chamber 2 into 75,000 Nm$^3$ synthetic raw gas at 3 MPa (30 bar). In addition to the mineral coal dust and steam, the pilot burner gas 10 includes the oxidation means comprising a free oxygen. The gasification burner 1 is arranged in a burner fastening apparatus 3. The gasification chamber 2 is delimited by a cooling screen 8 formed from gas-tight welded cooling tubes. The gasification temperature measured on the outlet apparatus 16 amounts to 1,500° C. The hot gasification gas leaves the gasification chamber 2 together with the liquid slag produced from the mineral coal dust via the outlet apparatus 16 and enters the cooling chamber 17, in which the gasification raw gas is cooled to approx. 200° C. by injecting cooling water via the nozzles 9 and is at the same time saturated with steam. The cooled raw gas is then supplied to further gas preparation technologies.

An annular gap is disposed between the pressure mantle 4 of the gasification reactor and the cooling screen 8, said gap being filled with a cooling liquid, in particular water, and having to be protected against low pressure and excessively high overpressure. It is expedient to maintain approximately the same pressure relative to the gasification chamber 2 in the annular gap. This is achieved by maintaining a corresponding pressure in the steam drum 19 and/or the pressure automatically adjusts according to the pressure in the raw gas line 22. The annular gap 5 is connected to the quenching chamber 17 or as shown in FIG. 1 to the raw gas line 22 by way of a steam drum 19. When the connecting line 21 is incorporated into the raw gas line 22, water can be injected by way of the jet in order to flush deposits of solid particles out of the raw gas and thus to permanently ensure the functionality. To ensure the seal tightness between the annular gap 5 and the gasification chamber, a solid connection 12 to the pressure mantle is established at the upper end of the cooling screen 8. The gap arising between the upper end of the cooling screen 8 and the burner fastening unit 3 is filled during assembly. The cold water for the cooling screen 8 is supplied and/or drained by way of the connections 6 and 7.

The invention claimed is:

1. A reactor for the gasification of solid and liquid fuels in the entrained bed, comprising:

a cooling screen;

a gasification chamber circumscribed by said cooling screen;

a pressure mantle; and a quenching chamber positioned downstream of said gasification chamber configured to receive and quench raw gas produced in the gasification chamber, wherein the reactor operates at temperatures between 1,200 and 1,900° C. and pressures between ambient pressure and 10 MPa, wherein the solid fuels include particulate crushed coal with different coalification degrees, petrol coke or other solid coal-containing materials and liquid fuels, oil or oil-solid or water-solid suspensions, wherein an oxidation means includes free oxygen, wherein an annular gap between the pressure mantle and the cooling screen is used as an internal water jacket filled with a liquid, and wherein the internal water jacket is connected with the raw gas line exiting the quenching chamber by way of a steam drum, thus performing a pressure corn sensation between the internal water jacket and the gasification chamber.

2. The reactor as claimed in claim 1, wherein a first pressure may be established in the internal water jacket, which is higher than a second pressure in the gasification chamber.

3. The reactor as claimed in claim 1, wherein the first pressure may be established in the internal water jacket, which is identical to or greater than the second pressure in the gasification chamber.

4. The reactor as claimed in claim 1, wherein, water may be injected into the raw gas line exiting the quenching chamber using a nozzle.

5. The reactor as claimed in claim 1, wherein the liquid that the internal water jacket is filled with is water or heat transfer oil.

* * * * *

UNITED STATES PATENT AND TRADEMARK OFFICE

CERTIFICATE OF CORRECTION

PATENT NO. : 8,083,817 B2
APPLICATION NO. : 12/739267
DATED : December 27, 2011
INVENTOR(S) : Volker Kirchhübel et al.

It is certified that error appears in the above-identified patent and that said Letters Patent is hereby corrected as shown below:

Col. 4, line 9, remove [corn sensation] and insert --compensation--

Signed and Sealed this
Fourth Day of December, 2012

David J. Kappos

David J. Kappos
*Director of the United States Patent and Trademark Office*